US011648599B2

(12) United States Patent
Seki

(10) Patent No.: US 11,648,599 B2
(45) Date of Patent: May 16, 2023

(54) METHOD AND SYSTEM FOR FORMING PROTRUSIONS, AND METHOD FOR MANUFACTURING METAL COMPONENT HAVING PROTRUSIONS

(71) Applicant: SEKI PRESS CO., LTD., Hitachi (JP)

(72) Inventor: Masakatsu Seki, Hitachi (JP)

(73) Assignee: SEKI PRESS CO., LTD., Ibaraki (JP)

( * ) Notice: Subject to any disclaimer, the term of this patent is extended or adjusted under 35 U.S.C. 154(b) by 137 days.

(21) Appl. No.: 17/054,908

(22) PCT Filed: May 29, 2019

(86) PCT No.: PCT/JP2019/021276

§ 371 (c)(1),
(2) Date: Nov. 12, 2020

(87) PCT Pub. No.: WO2019/230795

PCT Pub. Date: Dec. 5, 2019

(65) Prior Publication Data

US 2021/0213509 A1 Jul. 15, 2021

(30) Foreign Application Priority Data

May 31, 2018 (JP) ..... JP2018-104198
Jul. 27, 2018 (JP) ..... JP2018-140818

(51) Int. Cl.
*B21J 5/02* (2006.01)
*B21D 22/06* (2006.01)

(52) U.S. Cl.
CPC ..... *B21D 22/06* (2013.01)

(58) Field of Classification Search
CPC ..... B21J 5/08; B21J 9/027; B21J 9/022; B21J 9/02; B21J 9/06; B21J 13/025; B21J 13/02; B21D 22/06
See application file for complete search history.

(56) References Cited

U.S. PATENT DOCUMENTS 7,082,808 B2 8/2006 Knaup
2002/0157444 A1 10/2002 Heussen et al.
(Continued)

FOREIGN PATENT DOCUMENTS

DE 103 03 184 B3 4/2004
JP 6-315734 A 11/1994
(Continued)

OTHER PUBLICATIONS

First Examination Report issued in counterpart Indian Application No. 202027051070 dated Apr. 22, 2021 and its English translation.
(Continued)

*Primary Examiner* — Debra M Sullivan
(74) *Attorney, Agent, or Firm* — Norris McLaughlin, P.A.

(57) ABSTRACT

Solid metal protrusions are formed by a method including: clamping and fixing the metal workpiece with a support die and a pressure die; pressing each cross section of an outer peripheral end parts of the metal workpiece fixed with the support die and the pressure die at a temperature lower than a softening point of a metal used as the metal workpiece from a direction perpendicular or oblique to an upright direction of the protrusions to be formed on one surface of the metal workpiece by press molding using a pressing die or a pressing jig; undergoing plastic flows of metal into through-holes formed as recessed parts that serve as female molds for forming the protrusions in at least one of the support die and the pressure die; and forming solid protrusions on the surface of the metal workpiece.

9 Claims, 12 Drawing Sheets

(56) References Cited

U.S. PATENT DOCUMENTS

| | | | | |
|---|---|---|---|---|
| 2017/0136514 | A1* | 5/2017 | Sakamoto | B21D 22/022 |
| 2017/0136521 | A1* | 5/2017 | Sakamoto | B21D 49/00 |

FOREIGN PATENT DOCUMENTS

| | | | |
|---|---|---|---|
| JP | H09-298056 | A | 11/1997 |
| JP | 2001-328031 | A | 11/2001 |
| JP | 2002-143933 | A | 5/2002 |
| JP | 2004-017107 | A | 1/2004 |
| JP | 2004-330334 | A | 11/2004 |
| JP | 2005-153014 | A | 6/2005 |
| JP | 2007-014978 | A | 1/2007 |
| JP | 2009-248143 | A | 10/2009 |
| JP | 2011-050987 | A | 3/2011 |
| JP | 2013-066998 | A | 4/2013 |
| JP | 2014-166645 | A | 9/2014 |
| JP | 2017-094341 | A | 6/2017 |
| JP | 2017-094342 | A | 6/2017 |

OTHER PUBLICATIONS

Extended European search report dated Feb. 9, 2022.

* cited by examiner

METHOD AND SYSTEM FOR FORMING PROTRUSIONS, AND METHOD FOR MANUFACTURING METAL COMPONENT HAVING PROTRUSIONS

TECHNICAL FIELD

The present invention relates to a method for forming protrusions, a system for forming protrusions, and a method for manufacturing a metal component having the protrusions, in which the protrusions can be easily formed by press molding without making a metal plate thinner or without reducing the diameter of a metal plate, in relation of metal plates or metals rod having protrusions to be used for components or current collecting terminals of various devices, and so on.

BACKGROUND OF THE INVENTION

As conventional methods of forming one or more protrusions (or protruding parts) on a metal part, (1) a method for forming protrusions on one surface of a metal part by press molding of recessed parts on the back surface thereof, (2) a method for forging a metal material for forging, (3) a method for welding protrusions to the outer surface of a metal main body by a laser, TIG, and so on, (4) a method for sticking protrusions to a metal main body by inserting fitting portions formed at the base of the protrusions into holes formed in the metal main body and crimping the inserted fitting portions, are known as described in Patent Document 1.

The method for forming protrusions by press molding according to the above (1) is applied not only to inertial arms for HDD disclosed in Patent Document 1, but also to embossed molded products, heat radiating plates, current collecting terminals, and so on, resulting in a highly versatile technology with a wide range of applications. The method according to the above (1) is applied in combination with post-processing in which the back surface or the formed surface of a protrusion is cut or polished in order to flatten one surface of a metal plate after protruding the protrusion by press forming (see Patent Documents 2 and 3). A method of forming a truncated cone-shaped protrusion in which the wall thickness of a tip portion is thicker than that of an outer peripheral wall, is also proposed by combining the method disclosed in the Patent Document (1) with the pre-process of squeezing by a press. (See Patent Document 4)

As another method for forming protrusions by press forming, Patent Document 5 discloses a method for forming protrusions in which a part of the metal plate is pushed into a recessed part by performing a press working, wherein a pressing die having the protrusion-shaped recess is pressed against the metal plate. Furthermore, Patent Document 6 proposes a method for forming protrusions, the method comprising: fitting a second die to a first die having a cavity with a protrusion part by sliding the second die to match the cavity of the first die; moving the second die toward the first die; and filling and molding a metal material between the cavity of the first die and the second die.

In addition, Patent Document 7 proposes a method for forming protrusions, the method comprising: pressing two adjacent positions on one surface of a metal workpiece; forming metal flow portions in opposite directions between the two adjacent positions; and forming raised portions (protruding portions) of the metal workpiece.

On the other hand, a technique of forming protrusions by using a hollow metal base tube instead of using a metal plate or a metal rod is also disclosed. For example, Patent Document 8 discloses a method for forming a hollow shaft with protrusions by a hydraulic bulge processing, in which a die is slid in the axial direction of a metal base tube while injecting a processing liquid inside the metal base tube.

Further, instead of forming the protrusions as described above, a method for manufacturing a press-molded product by forming thick portions on a metal flat plate member and a molding device thereof have also been proposed (for example, Patent Documents 9 and 10). In the method for producing a press-molded product, as disclosed in Patent Document 9, the flat plate part of the metal flat plate member is pressed by bringing a first press portion and a second press portion closer to each other, wherein the first press portion faces the first end of the flat plate portion and the second press portion faces the second end that is located in a opposite side to the first end. In the method for manufacturing a molded product, as described in Patent Document 10, in order to avoid a wall thinning during press molding, a compressive force is applied from a orthogonal direction of a metal plate sandwiched between forging molds to the thickness direction thereof, and the forging is performed to locally or continuously form a thickened portion thicker than the material thickness of the metal plate.

RELATED ART

Patent Literature

[Patent Document 1] Japanese Unexamined Patent Application Publication No. 2001-328031

[Patent Document 2] Japanese Unexamined Patent Application Publication No. 2013-66998

[Patent Document 3] Japanese Unexamined Patent Application Publication No. 2004-330334

[Patent Document 4] Japanese Unexamined Patent Application Publication No. 2011-50987

[Patent Document 5] Japanese Unexamined Patent Application Publication No. 2002-143933

[Patent Document 6] Japanese Unexamined Patent Application Publication No. 1997-298056

[Patent Document 7] Japanese Unexamined Patent Application Publication No. 2005-153014

[Patent Document 8] Japanese Unexamined Patent Application Publication No. 2004-17107

[Patent Document 9] Japanese Unexamined Patent Application Publication No. 2017-94341

[Patent Document 10] Japanese Unexamined Patent Application Publication No. 2007-14978

SUMMARY OF THE INVENTION

Problems to be Solved by the Invention

As compared with the above-mentioned (2) the forging method, (3) the welding method, and (4) the caulking method, the above-mentioned (1) the press forming method is a technique that has been conventionally useful as a method for forming protrusions, because the press forming method has several advantages, such as formation of high-quality protrusions, a suitable applicability to precision metal parts, a simplified process of forming protrusions, the low cost production, and so on.

However, the conventional methods for forming protrusions or thick-walled portions have the following technical problems, as disclosed in Patent Documents 1 to 10. That is, the methods disclosed in Patent Documents 1 to 4 have problems that solid protrusions cannot be formed, that it is difficult to form high-quality protrusions because it is likely to occur cracks or breaks in protrusions or their peripheral portions in the case of a thin metal plate or a metal rod having a small diameter, and that the process becomes complicated because the post-process such as cutting, polishing, or so on is required.

The methods disclosed in Patent Documents 5 and 6 also have the following problems when applying the methods to a thin metal plate and a metal rod, respectively. In the former case, the application of the methods to the thin metal plate is difficult, because the main body thickness of the thin metal plate becomes thinner after forming the protrusions. In the latter case, it is difficult to press the metal rod uniformly by a press forming, and not only is the height of the protrusions greatly restricted, but it is also likely to generate a local deformation in the body part of the metal rod after formation of the protrusions. In particular, in the method disclosed in Patent Document 5, not only was the quality of the protrusions inferior, but the diameter and the height of the formed protrusions were also severely restricted, since the metal plastic flow by pressing changes in three directions of a vertical downward direction→a horizontal direction→a vertical upward direction, and thereby the metal plastic flow to the recessed part having a protrusion shape cannot be smoothly performed.

The method disclosed in Patent Document 7 has a poor degree of freedom in selecting the shape of the protrusions, since the formed protrusions are limited to an annular shape, and more may cause an appearance problem that dents may be generated on the surface of the metal body (the surface on which the protrusions are formed) after a processing. Further, if the protrusions are to be formed highly, the dents seen on the metal surface after the processing become large, which may adversely affect the strength of the protrusions and the metal body. From the above, the method disclosed in Patent Document 7 is not suitable for application to metal parts requiring high quality or high precision protrusions, for example, current collecting terminals.

On the other hand, the method for forming a hollow shaft with protrusions fundamentally targets a hollow metal element tube as a workpiece, as described in Patent Document 8. The Patent Document 8 fails to describe and suggest a method for forming protrusions on one surface of a metal plate or a metal tube. It cannot be said that the invention of the Patent Document 8 is one that recognizes such the method.

Further, the methods disclosed in the Patent Documents 9 and 10 are ones for forming a thick-walled portion on a metal flat plate member, in which the thick-walled portions (the thickened portions) are generally formed in a low shape having the size that the protrusion height from the metal flat plate member is smaller than the thickness of the metal flat plate member. In the Patent Documents 9 and 10, as specifically disclosed as the method for forming thickened forming portions, only a heat or warm working (hot pressing) for forging, or a press forming by heating a metal flat plate member as a whole or locally, is available. A cold working has only been suggested therein. Therefore, it has been difficult to apply the methods disclosed in the Patent Documents 9 and 10 as they are, as a forming method of high protrusions by press forming at a temperature lower than the softening point of a work metal. In particular, Patent Document 9 discloses the press forming method, in which a first press portion facing the first end of the flat plate portion is slid together with a second press portion facing a second end located in an opposite side to the first end. However, the height of the thickened portion that can be formed was limited, since a slidable distance and an applicable press pressure during molding were restricted.

The present invention has been made to solve such problems. Objects of the present invention are to provide a method for forming protrusions and a system for forming protrusions, in which the solid protrusions can be easily formed by press molding without thinning a metal plate or reducing the diameter of a metal rod, in relation to metal plates or a metal rods having protrusions to be used for parts of various devices, current collecting terminals, and so on.

Furthermore, another object of the present invention is to provide a method for manufacturing a metal part having protrusions formed by the method for forming protrusions.

Means for Solving the Problems

Unlike the conventional press forming methods, the present invention has been made according to the present inventor's finding that the above-mentioned problems can be solved by adopting a method, comprising: pressing a cross section of an outer peripheral end part of each workpiece from the horizontal direction, not from a vertical direction, to the upper and lower surfaces of a metal plate used as a workpiece, or a longitudinal direction of a metal rod used as the workpiece; and undergoing plastic flows into one or more through-holes formed as recessed parts that serve as female molds for forming the protrusions.

That is, the configuration of the present invention is as follows.

[1] The present invention provides a method for forming protrusions to form one or more protrusions on one or more surfaces of a metal workpiece, the method comprising:

clamping and fixing the metal workpiece with a support die and a pressure die;

pressing each cross section of outer peripheral end parts of the metal workpiece fixed with the support die and the pressure die from a direction perpendicular or oblique to an upright direction of the protrusions to be formed on one surface of the metal workpiece by press molding using a pressing die or a pressing jig that is furnished separately from the support die and the pressure die;

undergoing plastic flows into one or more through-holes formed in at least one of the support die and the pressure die as recessed parts that serve as female molds for forming the protrusions; and forming one or more solid protrusions on the surface of the metal workpiece, wherein the pressing is performed at a temperature lower than a softening point of a metal used as the metal workpiece.

[2] The present invention provides the method for forming protrusions according to the preceding [1], wherein the pressing by the press molding from each cross section of the outer peripheral end parts of the metal workpiece is performed from two or more directions positioned in point symmetry when the center of the bottom surface of the protrusion to be formed is a symmetrical center, or from circumferential directions of the bottom surface of the protrusion.

[3] The present invention provides the method for forming protrusions according to the preceding [2], wherein the metal workpiece has one or more metal portions in two or more directions that are different from a longitudinal direction of the metal workpiece and are positioned in the symmetry point, or metal portions extending in the circumferential direction of the bottom surface of the protrusion.

[4] The present invention provides the method for forming protrusions according to any of the preceding [1] to [3], wherein the pressing by the press forming is performed at room temperature.

[5] The present invention provides the method for forming protrusions according to any of the preceding [1] to [4], wherein a pressure for clamping the metal workpiece with the support die and the pressure die is continuously or stepwise increased from the first half to the second half of a pressing process by the press forming.

[6] The present invention provides a system for forming protrusions to form one or more solid protrusions on one surface of a metal workpiece, the system comprising;

a support die for supporting a metal workpiece;

one or more recessed parts serving as female molds for forming the protrusions on one surface of the metal workpiece;

a pressure die for suppressing a lifting of the metal workpiece;

a clamping device having the support die and the pressure die;

a pressing die or a pressing jig for pressing each cross section of outer peripheral end parts of the metal workpiece, the pressing die or the pressing jig being furnished separately from the support die and the pressure die; and a press molding machine for pressing each cross section of the outer peripheral end parts of the metal workpiece by press forming using the pressing die or the pressing jig, wherein one or more through-holes are formed as the recessed parts in at least one of the support die and the pressing die, and wherein the pressing is performed at a temperature lower than a softening point of a metal used as the metal workpiece.

[7] The present invention provides the system for forming protrusions according to the preceding [6], wherein the press forming machine for pressing each cross section of the outer peripheral end parts of the workpiece has a cam mechanism for converting a pressing force acting in a direction perpendicular to a clamping surface of the pressure die to a force acting in a direction parallel thereto through the pressing die or the pressing jig.

[8] The present invention provides the system for forming protrusions according to the preceding [6] or [7], wherein the system has no heating device.

[9] The present invention provides a method for manufacturing a metal component having protrusions, having a main body part of the metal workpiece and the protrusions protruding from the main body part integrally, the method comprising:

forming the protrusions by the method for forming protrusions according to any of the preceding [1] to [5]; and separating the main body part of the metal workpiece from the metal workpiece having the protrusions by punching or cutting.

[10] The present invention provides the method for manufacturing a metal component having protrusions according to the preceding [9], the method further comprising:

press-extruding rear surfaces of the protrusions, or forming the protrusions by pressing a press die having one or more recessed parts to a work surface of the metal workpiece.

[11] The present invention provides the method for manufacturing a metal component having protrusions according to the preceding [9] or [10], the method further comprising:

polishing or cutting at least back surfaces of portions including the protrusions after forming the solid protrusions in the metal workpiece.

[12] The present invention provides a method for manufacturing a metal component having protrusions according to any of preceding [9] to [11], wherein the forming of the solid metal protrusions and other process performed in combination with the forming of the solid metal protrusions are continuously performed by a progressive method or a transfer method, wherein the other process includes at least any of separating a main body part of the metal workpiece from the metal workpiece having the protrusions by punching or cutting, press-extruding rear surfaces of the protrusions, or pressing a press die having one or more recessed parts to a work surface of the metal workpiece by press pressing molding, and polishing or cutting at least back surfaces of portions including the protrusions.

[13] The present invention provides the method for manufacturing a metal component having protrusions according to any of the preceding [9] to [12], wherein the metal component is a current collecting terminal.

Advantageous Effects of the Invention

According to the method for forming protrusions in the present invention, solid protrusions can be easily formed without making a metal plate thinner or reducing the diameter of a metal rod, in relation to metal plates or metal rods having protrusions to be used for components or current collecting terminals of various devices, and so on. In addition, solid protrusions can be easily formed higher than the thickness of a metal plate or the diameter of a metal rod, wherein the metal plate or the metal rod is used as the work. On the back surfaces of the solid protrusions formed at that time, only traces after the plastic flow of metal generated by press molding can be seen as small residual recesses, and an almost flat back surface can be formed, resulting in omission of the process for polishing or cutting the back surfaces of the protrusions. Alternatively, in the case of that the flat back surface is formed by eliminating the traces seen after the plastic flow of metal, the present invention has an advantage that the cutting or polishing process can be performed in a short time, as compared with the conventional extrusion method by a press forming.

The method for forming protrusions according to the present invention can easily form not only the protrusions with a high quality, due to formation of the solid protrusions having high uniformity and high strength in comparison with the conventional extrusion molding method of powder metal or the molding method of semi-molten metal, but also two or more protrusions at desired positions on the metal workpiece. For example, when the metal workpiece is a metal plate, the protrusions can be formed not only on the upper and lower surfaces of the metal plate but also on both side surfaces. Furthermore, it is possible to form the protrusions not only in the direction perpendicular to at least one surface of the metal workpiece but also in the diagonal direction thereto. The protrusions can also be formed in not only a conical shape but also a pyramidal shape. Thus, it is possible to widen the range for selecting a direction (an angle) at which the protrusion is formed and a shape of the protrusion.

In addition, the method for forming protrusions according to the present invention can be performed at a lower molding temperature when forming the protrusions, as compared with the conventional method of molding semi-molten metal. The specific molding temperature in the present invention is lower than the softening point of a metal material used as the workpiece, and it is possible to form the solid protrusions having a uniform shape even in the molding at room temperature. Further, a system for forming protrusions to according to the present invention does not need to use an additional device such as a heating device and so on, since the system has a simple structure including a mold, a presser mold, a clamping device and a press molding machine, whereas the method of molding semi-molten metal needs to perform complicated managements such as injection molding conditions and so on by using a special molding apparatus such as a metal injection molding device. To control and manage the press molding conditions and so on in the present invention is also easier than when using the metal injection molding apparatus. Therefore, the manufacturing cost for forming the protrusions can be significantly reduced, as compared with the conventional method of molding semi-molten metal.

The method for manufacturing a metal component according to the present invention can not only form one or a plurality of solid protrusions with high strength at arbitrary positions, but also provide metal components having various shapes and functions by combining with the conventional process of the press extrusion molding, or the press pressing molding in which another pressure die having the recessed parts is pressed on the working surface. For example, it is possible to increase the height of the protrusions and to form the truncated cone-shaped protrusions so that the wall thickness of the protrusion tip is thicker than that of the outer peripheral wall. Furthermore, the present invention enables its application to expand not only to general-purpose metal components but also to precision metal components, since it can be applied to metal components having a thin metal plate or a small diameter metal rod as a main body.

MODES FOR IMPLEMENTING THE INVENTION

<Method for Forming Protrusions>

FIGS. 1A to 1D illustrate diagrams for explaining process outlines of a method for forming protrusions according to the present invention. In FIGS. 1A to 1D, a cross-sectional view of each process is shown on the left side, and a perspective view of a metal plate used as an example of a metal workpiece is shown on the right side before and after the process of forming a protrusion. The method for forming protrusions according to the present invention will be explained by FIGS. 1A to 1D.

Figure 1A:
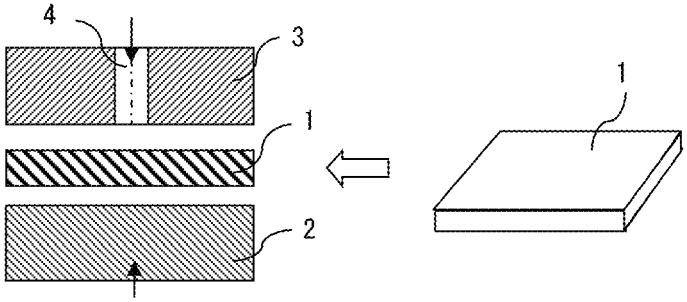
FIGS. 1A to 1D illustrate diagrams for explaining process outlines of a method for forming protrusions according to the present invention.
Figure 1B:
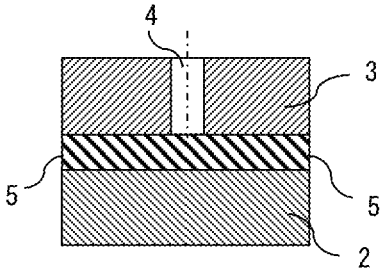

As shown in FIGS. 1A to 1D, a workpiece 1 of a metal plate is inserted between a support die 2 for supporting the work 1 and a pressure die 3 for holding the workpiece 1 (see FIG. 1A). After that, the support die 2 and the pressing die 3 are clamped in the direction of the arrow to fix the workpiece 1 (see FIG. 1B). Here, the pressure die 3 has a recessed part that serves as a female mold for a protrusion to be formed. In FIGS. 1A to 1D, as an example of the recessed part, a through-hole 4 is formed in the same diameter as the opening of the recessed part. In embodiments of the present invention, the recessed part of the pressure die 3 may be formed in a configuration of inserting a knockout pin into the through-hole 4. In the method for forming protrusions according to the present invention, a non-penetrating part having a shape equal to or longer than the height of a protrusion to be formed may be formed as the recessed part, but an application of the non-penetrating portion is limited to formation of a low protrusion.

Figure 1C:
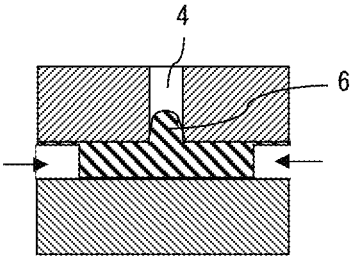

Next, as shown in FIG. 1C, the outer peripheral end part 5 of the workpiece 1 is pressed by press forming using a pressing die furnished in a press forming machine, or a pressing jig (not shown) such as a pressing punch and a pressing plunger, and the metal is plastically flowed from the two directions on both sides of cross sections of the outer peripheral end parts 5 of the workpiece 1 toward the through-hole 4. The metal flowed inside the through-hole 4 by the plastic flow forms the protrusion 6. Here, the height of the protrusion 6 can be controlled by adjusting the pressing force, pressing speed, and pressing time in the press forming. These operations are performed by selecting an appropriate pressing method, which is performed by continuous feed or intermittent feed.

In the present invention, it is practical to perform the press forming by setting the press load and the press load speed in the range of 1 to 50 tons and 0.1 to 50 mm/sec, respectively. In consideration of the efficiency in the performance and pressing of the press forming machine, the range of 1 to 10 tons and 1 to 10 mm/sec may be used, respectively. In addition, the pressure die 3 requires a high clamping pressure in order to suppress a lifting of the workpiece 1 when pressed by the press forming. The clamping pressure may be continuously applied with a high value set from the beginning of the pressing process. However, it is practical to adopt a method of continuously or stepwise increasing the clamping pressure from the first half to the second half of the pressing process, since the lifting of the workpiece 1 tends to increase in the latter half thereof. This method has an advantage of reducing wear of the support die 2 and the pressure die 3, and improving the life of the press forming machine, as compared with the case where the clamp pressure is increased from the beginning of the pressing process. In the present invention, the clamping pressure of the pressing die 3 is 10 tons or more, preferably 30 tons or more, and more preferably 50 tons or more in order to suppress the lifting of the workpiece 1. The upper limit of the clamping pressure is not particularly limited, but 200 tons or less is practical from the viewpoint of the capacity of the press molding machine and the life of the pressure die and the support die.

Figure 1D:
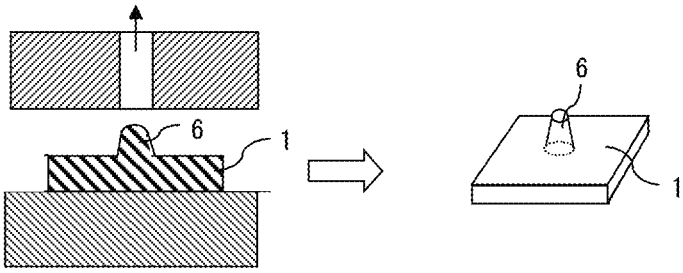

Finally, as shown in FIG. 1D, the clamp pressure is released, the pressure die 3 is demolded in the direction of the arrow (↑) and then the workpiece 1 having the protrusion 6 is taken out. On the back surface of the formed solid protrusion, only a trace after the plastic flow of metal generated by the press molding are seen as a small residual recessed part, and a substantially flat back surface is formed. When the trace after the plastic flow of metal is eliminated to form a flat back surface, the trace portion is cut into slices or only the trace portion is polished. The workpiece 1 on which the protrusion 6 are formed in this way is processed into a desired metal part by removing unnecessary portions from the main body portion of the workpiece by post-processing such as punching or cutting.

As described above, the method for forming protrusions according to the present invention can form the solid protrusion by pressing the cross sections 5 of the outer peripheral end part of workpiece 1 by the press molding from a direction perpendicular to the upright direction of the protrusion 6 when the protrusion 6 to be formed on the metal workpiece 1 is viewed as a reference position, and by plastically flowing the metal of the workpiece 1 inside a through-hole formed as a recessed part that serves as a female mold for forming the protrusion 6. Differing from the conventional method in which the workpiece 1 is extruded from the back surface of a protrusion in the direction perpendicular to the surface thereof by press forming, the present invention is characterized in that the pressing is performed against each cross section 5 of the outer peripheral end parts of workpiece 1 from a direction parallel to the surface of the workpiece 1. The present invention is also different from the method for forming a thick portion, as disclosed in Patent Document 9 or 10. In the present invention, the through-hole is formed as the recessed part of the pressure die 3, and each cross sections 5 of the outer peripheral end parts of workpiece 1 is press molded by using the pressing die or a pressing jig that is furnished separately from the support die 2 and the pressing die 3.

The workpiece used in the present invention is not limited to the rectangular metal plate as shown in FIGS. 1A to 1D. The workpiece may be a metal plate having any shape of a disk, an ellipse, and a polygon having three or more sides, or a metal rod or a flat metal having a cross-sectional shape of a circle, an ellipse, and three or more polygons. When a metal plate is used as the workpiece, it is not particularly necessary to use a plate-like material having a thickness equal to or greater than the total thickness of the metal body portion and the protrusion, differing from the invention disclosed in Patent Document 1. A thin strip material having a thickness of less than 5 mm may be used. A thick strip material of several tens of mm or more can be also used. In that case, the thickness of the applicable metal plate is determined by the capacity of the press molding machine used. On the other hand, when a metal rod is used as the workpiece, a rod-shaped material having a small diameter of less than 0.5 mm to a large diameter of several tens of mm or more can be used as in the case of the metal plate.

In the present invention, as the metal material to be a workpiece, not only metal materials having excellent press formability such as aluminum, aluminum alloy, copper, low carbon steel, magnesium and so on, but also metal materials having poor press formability such as high carbon steel, phosphor bronze, stainless steel, titanium and so on can be used if the press forming is possible. The present invention performed by pressing the cross section 5 of the outer peripheral end part of the workpiece 1 by the press molding can be applied by examining and optimizing molding conditions as long as the metal can plastically flow.

When a metal plate is used as the workpiece, as shown in FIGS. 1A to 1D, the protrusion is formed on one surface of the metal plate by pressing the metal plate from the peripheral end parts thereof with a pressing die or a pressing jig that is furnished in a press forming machine, while clamping and fixing the metal plate with the pressure die and the support die from above and below of the metal plate. At this time, the pressing die or the pressing jig is furnished in the press forming machine as a different configuration from the support die and the pressure die. In addition, the positions where the support die and the pressure die are installed are relative to each other, and both dies may be installed at opposite positions.

When a metal rod is used as the workpiece, the parts that come into contact with the metal rod in the pressure die and the support die are curved along the outer peripheral shape of the metal rod, and a recessed part that serves as a female mold for forming the protrusion is formed into the pressure die. In the case of the metal rod, the entire outer peripheral surface of the metal rod is considered as one surface of the workpiece. Here, it is practical that the pressing by the pressing die or the pressing jig furnished in the press forming machine is performed from each cross section of both end parts of the metal rod. The positions where the support die and the support die for clamping the metal rod are installed are relative to each other, and both dies may be arranged in reverse in the case of the metal plate.

In the embodiment of the present invention, the protrusion 6 can be formed not only in the direction perpendicular to the metal plate of the workpiece 1 but also in the oblique direction thereto. In that case, the through-hole 4 corresponding to the recessed part may be formed so as to be inclined in an oblique direction against the clamping plane of the pressure die 3. When a protrusions was formed in a diagonal direction to a metal plate, the conventional press molding performed by extruding from back surfaces of the protrusions required a complicated process such as making fine adjustment, because the press molding was performed by slanting an extrusion direction of the metal, or installing the support die in the oblique direction to the metal plate. In addition, the hollow protrusion formed by extrusion in the oblique direction easily cause cracks and breaks during the process, and the wall surface thickness tends to be uneven, which causes quality problems sometimes. On the other hand, the present invention does not need to perform such a complicated process. In the present invention, not only can the protrusions in the oblique direction be easily formed by a simple process, but the quality of the protrusions can be also improved.

Further, the method for forming protrusions according to the present invention can form the protrusions having various shapes, including not only a conical shape but also a pyramid shape as a protrusion shape. For example, in the case of the pyramidal protrusion, it can be easily formed only by making a cross-sectional shape of a recessed part of the pressure die 3 polygonal. In addition, the height of the protrusion can be adjusted only by changing the press forming conditions. Since the pyramidal protrusion formed in this way has a solid structure, it becomes a high-strength protrusion with high uniformity, as compared with the hollow structure obtained by the conventional extrusion method.

In the protrusion forming method shown in FIGS. 1A to 1D, the workpiece 1 is a rectangular metal plate, and the pressing direction by press forming is two directions. However, in the present invention, the pressing directions are not limited to two directions, and may be three or more directions. For example, in the case of a disk-shaped metal plate, the pressing direction by press forming may be from circumferential directions of the bottom surface of the protrusion to be formed. In the present invention, in order to form a high-quality protrusion having a uniform shape and a high strength, it is necessary to undergo plastic flows of the metal uniformly from each of the outer peripheral end parts toward the recessed part of the pressure die 3. Therefore, when pressing by press molding is performed in two or more directions, it is preferable to set each direction of pressing at a point-symmetrical position when the center of the bottom surface of the protrusion to be formed is a symmetrical center.

As shown in FIGS. 1A to 1D, when the cross sections 5 of the outer peripheral end of the workpiece 1 are pressed by press forming, the each position of both end cross sections 5 around the outer shape moves toward the direction of the through-hole 4 by undergoing the plastic flow of metal from the two directions on both end sides of the workpiece, which causes metal thinning in the two directions. As a result, the length of each pressing direction at the main end portions of the workpiece 1 after the formation of the protrusion 6 is shortened, and the shape and size of the workpiece 1 may change significantly before and after the formation of the protrusion depending on the application. In order to avoid this, the present invention may use a work in which the portion supporting the protrusion 6 and the portions reduced in length by the pressing may be separated.

Figure 2A:
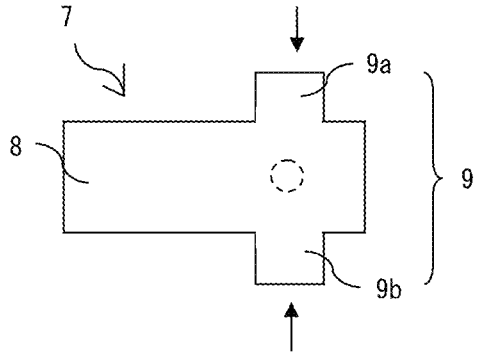
FIGS. 2A to 2C show examples of metal works in which a portion supporting the protrusions and portions reduced in length by pressing are separated.
Figure 2B:
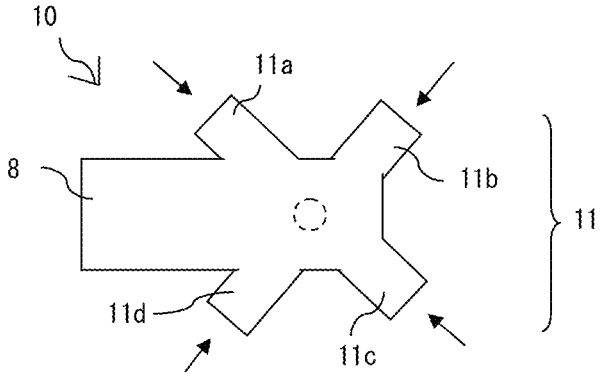
Figure 2C:
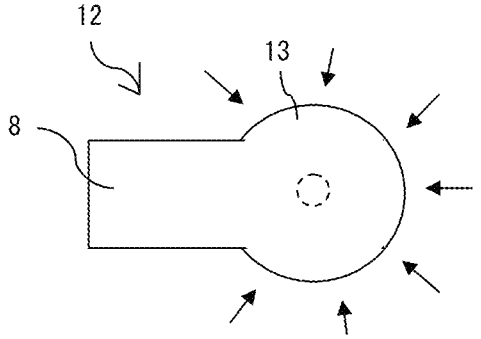

FIGS. 2A to 2C show examples of metal workpieces in which portions supporting protrusions and portions reduced in length by pressing are separated. FIGS. 2A to 2C show metal workpieces made of plate-shaped metal plates, and illustrate the shapes of the metal plates when viewed from the back surfaces. The bottom surface of the protrusion to be formed is represented by a circularly dotted line as each example of metal workpieces. As the pressed parts are indicated by arrows in FIGS. 2A, 2B, and 2C, the press forming is performed from two directions or four directions that are different from a longitudinal direction of the workpiece 7 or 10, or from circumferential directions around the bottom surface of the protrusion formed on the workpiece 12.

When the pressing is performed from two directions, the metal plate workpiece 7 has a part 8 supporting the protrusion to be formed, and 9*a* and 9*b* as the parts 9 pressed by press forming (FIG. 2A). When the pressing is performed from four directions, the metal plate workpiece 10 has the part 8 supporting the protrusion to be formed, and 11*a*, 11*b*, 11*c*, and 11*d* as the parts 11 pressed by press molding (FIG. 2B). When the pressing is performed from the circumferential directions, the metal plate workpiece 12 has the part 8 supporting the protrusion to be formed, and peripheral parts 13 pressed by press forming (FIG. 2C).

As shown in FIGS. 2A to 2C, it is preferable that the parts 9, 11 and 13 pressed by press forming in the metal plate workpieces 7, 10 and 12 are the shapes extending in two or more directions that are point-symmetrical, when the center of the bottom surface of each protrusion to be formed is a symmetrical center. As a result, it is possible to prevent the sizes of the workpieces 7, 10 and 12 from changing significantly before and after the protrusion formation, compared to those before the protrusion formation. The extending metal parts 9, 11 and 13 can be cut or polished to a desired length after the protrusions are formed and used as the main body part of the metal component. If necessary, the part 8 supporting the protrusion may also be cut or polished to a desired length at the same time. In the present invention, the extending metal parts are not limited to the two directions, four directions and the circumferential direction, as shown in FIGS. 2A to 2C, and may be formed in a plurality of directions including an even number of 6 or more or an odd number of 3 or more. In addition, even when the workpiece is a metal rod, a shape extending in two or more directions as a part of the workpiece pressed by press forming can be formed, based on the same concept as the metal plates shown in FIGS. 2A to 2C.

In the present invention, the protrusion formed on the metal plate is not limited to only one surface of the metal plate, and may be formed on one or more side surfaces thereof. Further, two or more protrusions may be formed on both top and bottom, or both sides of the metal plate. Also in the case of a metal rod, a plurality of protrusions can be formed at two or more arbitrary positions on the entire outer circumference thereof. A method of forming a plurality of protrusions on a metal plate or a metal rod will be described in detail in the embodiments described later.

The present invention is a method in which, when solid protrusions are formed on one surface of the work, the pressing by press molding can be performed at a temperature lower than a softening point of a metal material used as the workpiece. This is because the plastic flow of metal generated by the pressing is used when forming the solid protrusions. The pressing by press forming is practically performed at room temperature in order to eliminate complicated operations such as temperature control. As a method for forming solid protrusions that is different from the present invention has been conventionally proposed, for example, the method for forming protrusions by injection molding a metal in a semi-molten state heated above the softening point. However, the metal injection molding method not only requires the use of a special metal injection molding apparatus, but also involves complicated works for adjusting the temperature at the time of molding and setting the molding conditions. As compared with this metal injection molding method, the present invention simplifies the process because it is not necessary to use a special molding apparatus and it is possible to form more high protrusions without controlling the molding temperature. The method according to the present invention can also reduce the manufacturing cost. In addition, the present invention has an advantage of easily forming high protrusions at room temperature, as compared with the method for forming thick portions, as disclosed in Patent Documents 9 and 10.

<System for Forming Protrusions>

Figure 3:
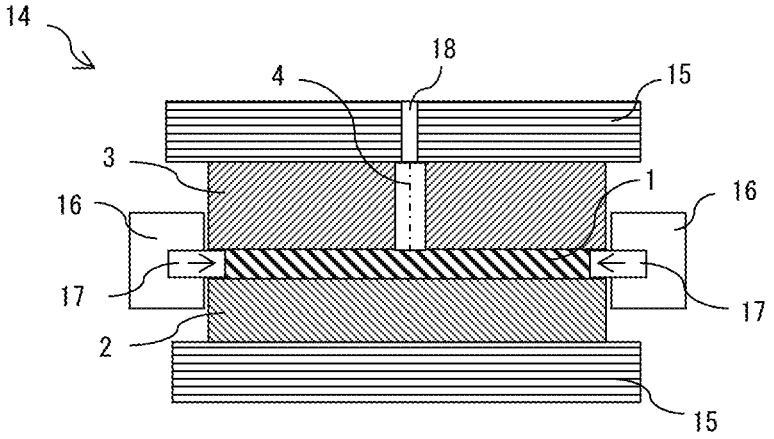
FIG. 3 illustrates a cross-sectional view showing a schematic configuration of a system for forming protrusions according to the present invention.

FIG. 3 illustrates a cross-sectional view showing a schematic configuration of a system for forming protrusions according to the present invention. As shown in FIG. 3, a system for forming protrusions 14 according to the present invention fundamentally comprises: a support die 2 for supporting a metal workpiece; a through-hole 4 corresponding to a recessed part serving as a female mold for the protrusion to be formed on one surface of the workpiece 1; a pressure die 3 for suppressing a lifting of the workpiece; a clamping device ((not shown) having clamping plates 15 for clamping the support die and the pressure die; and a press molding machine 16 for pressing each cross section of the outer peripheral end parts of the workpiece 1. An automatic clamping device is preferably used as the clamping device from the viewpoint of operability. The press molding machine 16 shown in FIG. 3 is a machine example having two pressing dies 17 which are furnished as an example of a pressing die or a pressing jig in order to press from two directions of each cross section of the outer peripheral end parts of the workpiece 1. In the present invention, three or more pressing dies may be furnished depending on the shape of the workpiece 1 and the pressing directions on the workpiece 1. The pressing die or the pressing jig is not limited to the pressing dies 17 shown in FIG. 3. For example, a pressing jig such as a pressing punch and a pressing plunger can be used.

As shown in FIG. 3, a small-diameter air vent-hole 18 connected to the through hole 4 of the holding die 3 is formed in the upper clamping plate 15. The air vent-hole 18 is formed to avoid a large pressure increase that occurs when a part of the metal enters the inside of the through-hole 4 by a plastic flow of metal when the protrusion is formed. When the amount of metal that penetrates into the through-hole 4 by the plastic flow may be small, such as when forming a low protrusion, the air vent-hole 18 may not be formed. In that case, the pressure die 3 may be provided with a recessed part of a non-through hole instead of the through-hole 4. However, when forming the protrusions at a height higher than the thickness of the work metal plate or the diameter of the work metal rod, it is indispensable to form the through-hole 4 as the recessed part in the pressure die 3. In the present invention, the through-hole 4 is therefore suitable as the recessed part. By using the system for forming protrusions 14 that has the above-described configuration, one or more solid protrusions can be formed on one surface of the metal work according to each process of the protrusion forming method described above.

Figure 4:
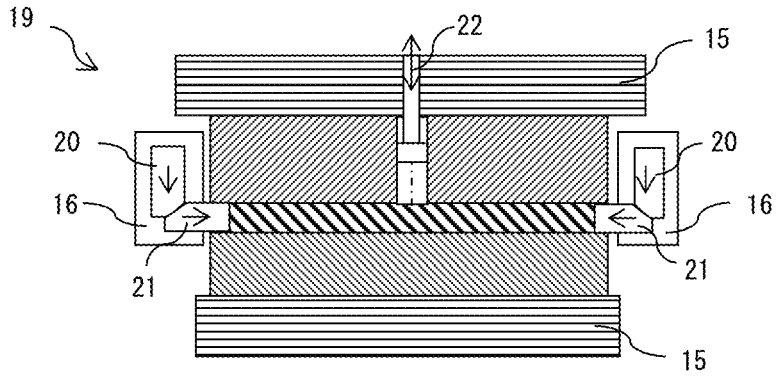
FIG. 4 illustrates a cross-sectional view showing a modified example of the system for forming protrusions according to the present invention.

FIG. 4 illustrates a cross-sectional view showing a modified example of the system for forming protrusions according to the present invention. In the system for forming protrusions 19, as shown in FIG. 4, a press forming machine 16 has a cam mechanism for converting a pressing force acting in a direction perpendicular to the clamp surface 15 of the pressure die 3 to a force acting in a direction parallel thereto through a pressing die or a pressing jig. As shown in FIG. 4, a cam with a function that can change an amount of movement can be used. The cam comprises: a cam drives 20; and a cam slides 21 functioning as the pressing die or the pressing jig. In the cam having such the function, the slopes of the cam drives 20 and the cam slides 21 are always in contact with each other, and the cam slides 21 also moves in a horizontal direction in proportion to a vertical movement of the cam drives 20. The system for forming protrusions according to the present invention not only makes the cam slides 21 function as the pressing die or the pressing jig, but also may adopt a configuration in which the pressing is performed toward each cross section of the outer peripheral end parts of the workpiece by a movement of the pressing die (for example, the pressing die 17 shown in FIG. 3) or a pressing jig accompanying a drive of the cam slide 21, wherein the pressing die or the pressing jig is arranged separately between the cam slide 21 and the cross section of the outer peripheral end part of the workpiece. As the press forming machine used in the present invention, a cam having a constant movable amount may be used instead of the cam having a variable movable amount. In addition, a method of pushing a cylindrical cam drive into the cam slide to move the cam slide horizontally, or a method of using a cam having a return mechanism may be adopted.

Since the system for forming protrusions, having the cam mechanism shown in FIG. 4, can collectively control the pressing of the press molding machine, the device configuration of the system can be simplified and the device itself can be made compact, as compared with the system shown in FIG. 3, in which the pressing is controlled in a distributed manner by the independent press molding machine. In particular, the effect obtained by the system 19 is enhanced when the cross sections of the outer peripheral end parts of the workpiece 1 are pressed from three or more directions.

In addition, the system shown in FIG. 4 has a knockout pin 22 to be inserted into the through-hole 4 of the support die 3. In the present invention, the knockout pin 22 does not have to be furnished, but when the height of the protrusion to be formed is adjusted or the head of the formed solid protrusion requires a precise structure, the use of knockout pins 2 simplifies their control.

<Method for Manufacturing a Metal Component>

The metal workpiece having the solid protrusions formed as described above is processed into the desired metal component by removing unnecessary portions from the main body of the metal workpiece by post-processing such as punching or cutting. Since the portion pressed by press molding leaves traces generated by the pressing after the protrusions are formed by press molding, it is necessary to remove these traces as unnecessary portions. The traces after the pressing are thin metal pieces that tend to remain around the reduced portion at each cross section 5 of outer peripheral end parts of the metal workpiece, that is, in the boundary between the support die and the pressure die after the process shown in FIG. 1 C. Even when the metal extending parts 9, 11 and 13 are provided as the pressed portions on the workpieces 7, 10 and 12, as shown in FIGS. 2A to 2C, the metal portions remaining without fitting into the desired size after being pressed by press forming are also removed by post-processing such as punching or cutting. Finally, the punching or the cutting is performed to process to the optimum component size when used as a metal component.

In the case that the present invention changes the shape and the structure of protrusions from the viewpoint of strength, function and design when manufacturing a metal component having protrusions with a higher height, or forming truncated cone-shaped protrusions so that the wall thickness of the protrusion tips is thicker than that of the outer peripheral wall, a process of extruding the back surfaces of the solid protrusions by press molding may be continued after the process of forming the protrusions according to the present invention. Furthermore, in the same way as the method disclosed in Patent Document 5, the pressing may be performed against the surface of the workpiece after the formation of protrusions by using another pressure die having protrusion-shaped recessed parts.

The method for manufacturing a metal component according to the present invention, may include a process of polishing or cutting the back surface of the portion involving the protrusions, after the process of forming solid metal protrusions. When traces of the metal plastic flow generated by press forming are seen as small residual recessed parts on the back surface of the formed solid protrusions, this process of polishing or cutting is performed to form a flat back surface by eliminating the traces. In that case, only the trace portions may be cut in a slice shape or may be polished, but not the entire metal part. When used in combination with the above-mentioned press extrusion molding process or the press pressing molding process, the polishing process or the cutting process may be performed before or after any of those processes. When used in combination with the punching process or the cutting process above, the polishing process or the cutting process can also be performed before or after any of the processes above. In short, it is preferable to combine the process of polishing or cutting the back surfaces of the protrusions with other process of pre-processing or post-processing so that a highly efficient process can be constructed as a method for manufacturing a metal component.

Thus, in the method for manufacturing a metal component having protrusions according to the present invention, at least any of processes including (a) punching or the cutting for processing the metal workpiece to an optimum part size, (b) the press extrusion molding or press pressing molding for changing the shape and structure of the protrusions, and (c) polishing or cutting for flattening the back surfaces of the protrusions are performed in combination with the process of forming the solid metal protrusions, if necessary. At that time, the process of forming the solid metal protrusions and at least any of the processes including (a), (b), and (c) above may be performed separately as an independent process, or as a continuous process by a progressive method or a transfer method. By constructing the manufacturing line of a metal component by the progressive method or the transfer method, the automation of the line becomes easy, and the metal component having the protrusions can be manufactured efficiently and with stable quality. Thereby, it is possible to provide a high quality metal component at low cost.

The manufacturing method according to the present invention can be applied to various metal components. In particular, a large effect can be obtained by the present invention when applied to a method for manufacturing a current collecting terminal that requires at least one of a high strength, a high protrusion shape, a good electrical conductivity. As the current collector terminal, the present invention can be applied to applications such as storage batteries, connectors, and wiring connections used for applications of electrical and electronic parts, transportation equipment such as automobiles, and industrial equipment such as machine tools.

Embodiments of the method for forming protrusions and the method for manufacturing a metal component according to the present invention will be described below, but the present invention is not limited to the following embodiments.

First Embodiment

The present embodiment will explain a method for forming protrusions that is performed according to the processes shown in FIG. 1 using a metal plate of C1100-1/4 series copper having a thickness of 1.5 mm as a workpiece 1.

The copper plate workpiece before forming a protrusion had the same shape as shown in FIG. 2B, The copper plate having four portions pressed by press molding was used, wherein the four portions extend in four laterally oblique directions located point-symmetrically with respect to the part supporting the protrusion when the center of the bottom surface of a formed protrusion is a symmetrical center.

In the present embodiment, as in the method shown in FIG. 1, a protrusion was formed according to the following processes: (a) inserting the workpiece 1 of the copper plate having the above shape between a support die 2 and a pressure die 3; (b) clamping the workpiece 1 by the support die 2 and the pressure die 3; (c) forming the protrusion 6 by pressing each cross section of the outer peripheral end parts of the workpiece 1 having four extending portions to be pressed from the four directions of the extending portions with a pressing die or a pressing jig by press molding using a press forming machine, and undergoing a plastic flow of metal into a through-hole 4 corresponding to a recessed part of the pressure die 3; and (d) releasing the clamping pressure and taking out the workpiece 1 having the formed protrusion 6 in the state where the pressure die was removed. Here, as shown in FIG. 4, a servo press machine having a cam mechanism at four places to be pressed was used as the press forming machine, wherein the servo press machine had a configuration of pressing cam slides 21 intermittently by making the cam slides 21 function as a pressing die or a pressing jig. The pressing process by press forming was performed at room temperature without heating the copper plate of the workpiece 1. The clamp pressure of the pressure die 3 was set to 10 tons immediately after press forming, and then gradually increased with the pressing time, and set to 80 tons at the end of pressing. Finally, the workpiece 1 having the formed the protrusion was processed into a circular shape by cutting the portions extending in four directions and around the protrusion.

Figure 5A:
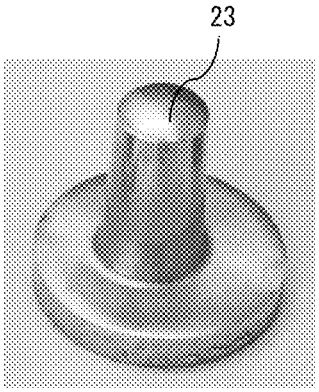
FIGS. 5A and 5B show photographic views showing the appearance and the cross section of a copper plate having protrusions formed by the method for forming protrusions in the first embodiment of the present invention, respectively.
Figure 5B:
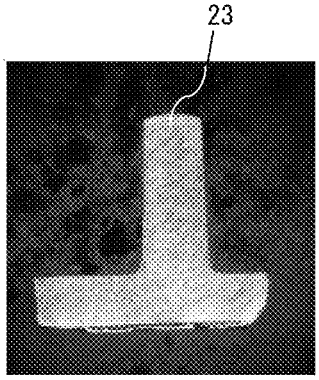

FIGS. 5A and 5B show the appearance and the cross section of the copper plate having the protrusion 23 formed by this method, respectively. FIGS. 5A and 5B are the photographic views showing the appearance and cross section of the copper plate, respectively. As shown in FIG. 5A, the solid protrusion 23 having the height of 7 mm or more was formed on one surface of the copper plate. As shown in FIG. 5B, no cracks or so on were observed in the cross section of the solid protrusion 23. It can be understood that the pressing was performed smoothly in the pressing process of the protrusion forming method (the process shown in FIG. 1C). Almost no trace of the plastic flow of metal generated by press molding is observed on the bottom surface of the solid protrusion 23. It can be understood that the substantially flat back surface is formed. In addition, from FIG. 5B, no initial grain boundary, no deformation band, and no macroscopic structure were observed at the tip, the rising portion, and the bottom of the protrusion. The present embodiment confirms that the solid-shaped protrusion 23 with the uniform refinement of metal crystal grains was formed in a high shape having a size larger than the thickness of the copper plate (1.5 mm).

Second Embodiment

Instead of the copper plate used as the workpiece 1 in the first embodiment, an A5052-H32 series aluminum plate was used, and a protrusion was formed on one surface of the aluminum plate in the same manner as in the first embodiment. The shape of the aluminum plate before forming the protrusions is also the same as that of the copper plate in the first embodiment.

Figure 6A:
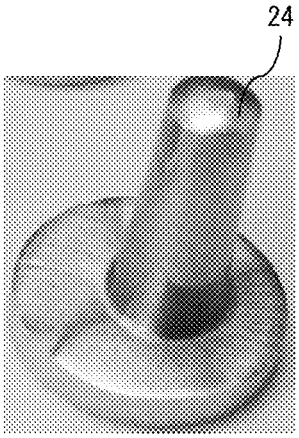
FIGS. 6A and 6B show photographic views showing the appearance and the cross section of an aluminum plate having protrusions formed by the method for forming protrusions in the second embodiment of the present invention, respectively.
Figure 6B:
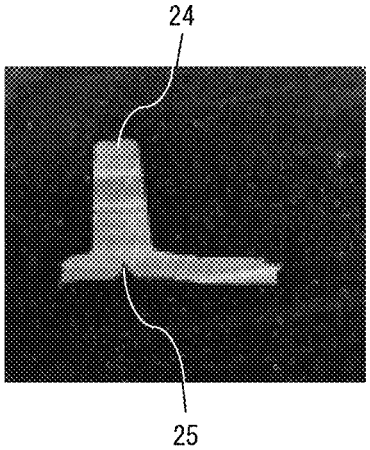

FIGS. 6A and 6B show photographic views showing the appearance and the cross section of the aluminum plate having the formed solid protrusion 24, respectively. As shown in FIG. 6A, the solid protrusion 24 having the height of 7 mm or more was formed on one surface of the aluminum plate. In addition, as shown in FIG. 6B, no cracks or so on are observed in the cross section of the protrusion 24, and it can be seen that the pressing process in the method for forming protrusions (the process shown in FIG. 1C) was smoothly performed in the same way as that of the copper plate of the first embodiment. On the other hand, a slight depression (recessed part) 25, which is a trace of the plastic flow of metal generated by the press forming, was observed on the bottom surface of the solid protrusion 24. This is because aluminum, which is softer than copper, was used as the metal material of the work plate, However, this recessed part 25 was completely eliminated by polishing the portion of 1.3 mm from the bottom surface of the protrusion. Furthermore, by optimizing the pressing conditions in the press forming, for example, by slightly slowing down a pressing speed by an intermittent type, the size of the recessed part 25, which is a trace due to the plastic flow of aluminum, can be reduced.

As shown in FIG. 6B, in the case of the aluminum plate as well as the copper plate, no initial grain boundary, no deformation band and no macroscopic structure were observed completely at the tip, the rising part and the bottom of the protrusion. Thus, it has been confirmed that in the present embodiment, the solid protrusion with the uniform refinement of the metal crystal grains is formed in the high shape having a size larger than the thickness (1.5 mm) of the aluminum plate.

Third Embodiment

Figure 7A:
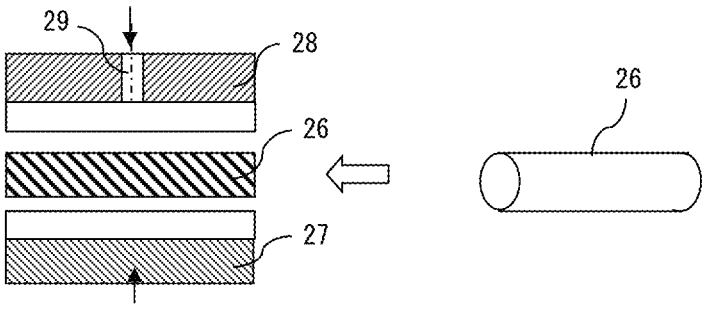
FIGS. 7A to 7D illustrate diagrams for explaining process outlines for forming a protrusion using a metal rod as a workpiece in the third embodiment of the present invention.
Figure 7B:
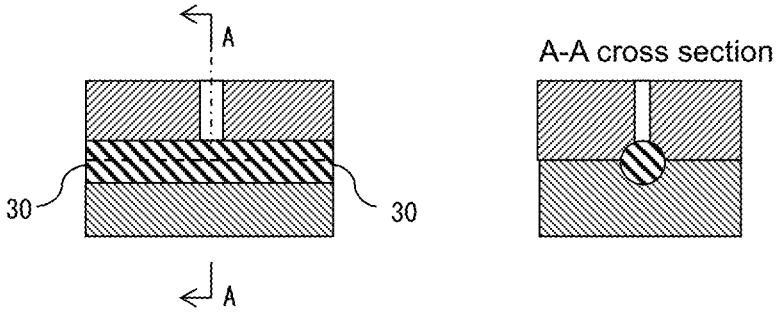
Figure 7C:
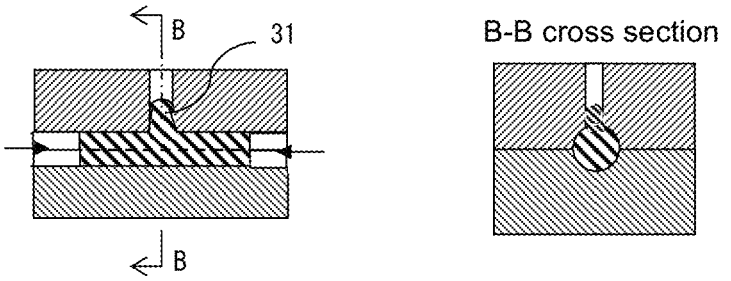
Figure 7D:
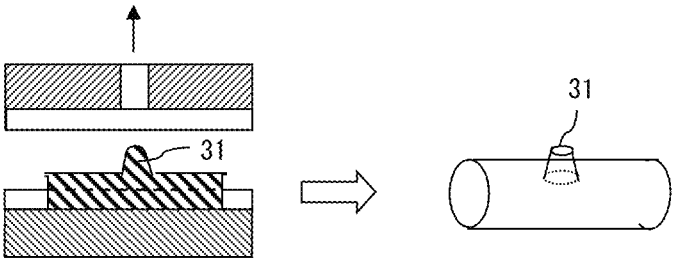

FIGS. 7A to 7D illustrate diagrams for explaining process outlines for forming a protrusion using a metal rod with a circular cross-sectional shape as a workpiece in the present embodiment. The cross-sectional view of each process is shown on each left side of FIGS. 7A to 7D. On each right side of FIGS. 7A and 7D, perspective views of the metal rod used as an example of the metal workpiece are shown before and after the process of forming the protrusion, respectively. FIGS. 7B and 7C show cross-sectional views taken along A-A line and B-B line in each process. A protrusion forming method when forming a protrusion on one surface of a metal rod will be described by FIGS. 7A to 7D.

As shown in FIGS. 7A to 7D, in the present embodiment a protrusion was formed according to the following processes: (a) inserting a workpiece 26 of the metal rod between a support die 27 and a pressure die 28; (b) clamping the workpiece 26 with the support die 27 having a circular cross section that follows a cross-sectional shape of the workpiece 26, and a pressure die 28; (c) forming a protrusion 31 by pressing each cross section 30 of the outer peripheral end parts of the workpiece 26 from two directions of the workpiece 26 to be formed with a pressing die or a pressing jig (not shown) by press molding using a press forming machine, and undergoing a plastic flow of metal into a through-hole 29 corresponding to a recessed part of the pressure die 28; and (d) releasing the clamping pressure, removing the pressure die, and taking out the workpiece 26 of the metal rod on which the protrusions are formed. In this way, the protrusion 31 without cracks or chips can be formed on the workpiece 26 of the metal rod.

Fourth Embodiment

FIGS. 8A to 8D illustrate diagrams showing processes of forming a diagonal protrusion on a metal plate workpiece in the present embodiment of the present invention. In FIGS. 8A to 8D, a cross-sectional view of each step is shown on the left side, and perspective view of a metal plate used as an example of a metal workpiece are shown on each right side before and after each process of forming the protrusion. A method of forming protrusions in which the protrusion is formed obliquely against one surface of the metal plate will be explained by FIGS. 8A to 8D.

Figure 8A:
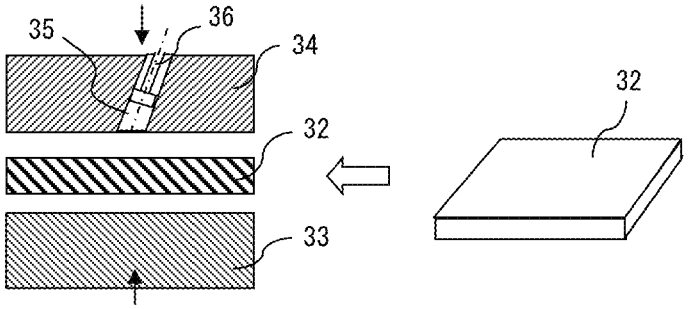
FIGS. 8A to 8D illustrate diagrams showing processes of forming a diagonal protrusion on a metal plate workpiece in the fourth embodiment of the present invention.
Figure 8B:
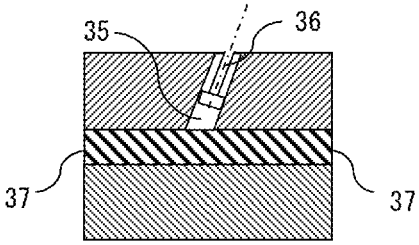

In the present embodiment, after a workpiece 32 of the metal plate is inserted between a support die 33 for supporting the workpiece 32 and a pressure die 34 for holding the workpiece 32 (in FIG. 8A), the support die 33 and the pressure die 34 are clamped in the directions of the arrows (in FIG. 8B). Here, the pressure die 34 has a through-hole 35 formed in an oblique direction against one surface of the workpiece 32 in accordance with the direction of the protrusion to be formed, and a knockout pin 36 inserted into the through-hole 35.

Figure 8C:
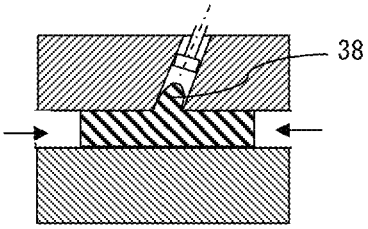

Next, as shown in FIG. 8C, the protrusion is formed in the oblique direction by pressing each cross section 37 of outer peripheral end parts of the workpiece 32 from a plurality of directions of the outer peripheral end parts of the workpiece 32 to be pressed with a pressing die or a pressing jig (not shown) using a press forming machine, and by undergoing a plastic flow of metal into the through-hole 35 corresponding to a recessed part of the pressure die 34. At this time, a sudden increase in pressure can be suppressed by gradually moving the knockout pin 36 upward of the pressure die 34, since the internal pressure of the through-hole 35 increases with the formation of the protrusion 38.

Figure 8D:
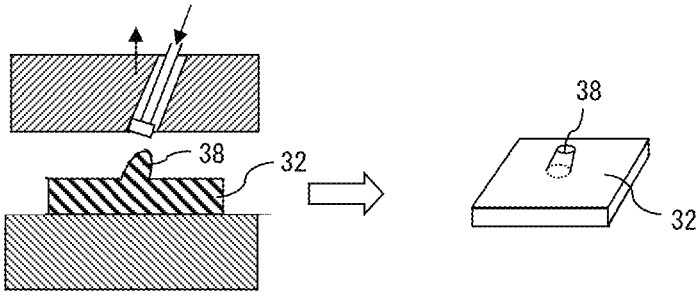

After that, as shown in FIG. 8D, the clamp pressure is released and the knockout pin 36 is moved below the pressing die 38 to eject the pressing die 34 from the workpiece 32 while protruding the head of the protrusion 38. Then, the metal plate workpiece 32 on which the protrusion 38 is formed is taken out.

Thus, the protrusion 38 is formed in the oblique direction against one surface of the workpiece 32 of the metal rod. The oblique protrusion 38 formed by the present embodiment can be formed only by filling the through-hole 35 corresponding to the recessed part of the pressure die 34 with the plastic flow of metal. Therefore, the uniformity of the internal metal structure is good, and it is possible to form the protrusion 38 without cracks or chips in appearance.

Fifth Embodiment

In the present embodiment, a method for forming a plurality of protrusions on a metal plate or a metal rod used as a workpiece will be explained by FIGS. 9A and 9B.

Figure 9A:
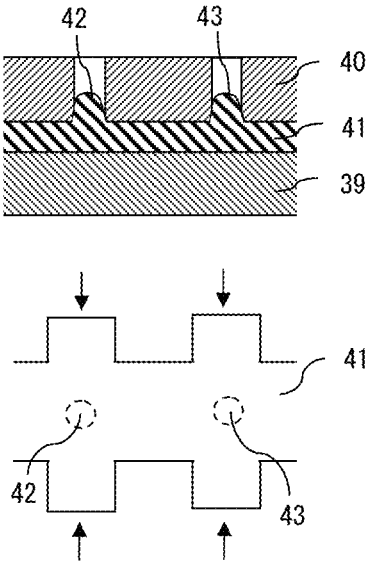
FIGS. 9A to 9D illustrate diagrams showing pressing processes by a press molding when forming a plurality of protrusions on one surface or both surfaces of a metal plate workpiece in the fifth embodiment of the present invention.
Figure 9B:
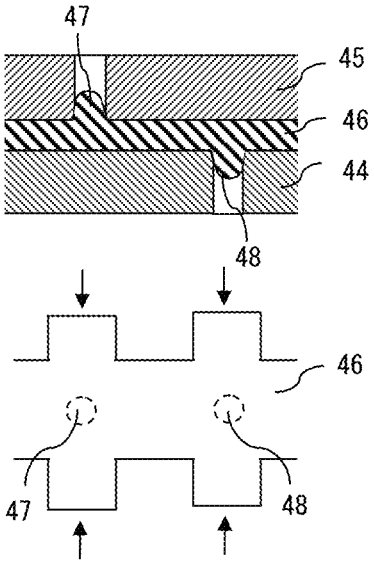
Figure 9C:
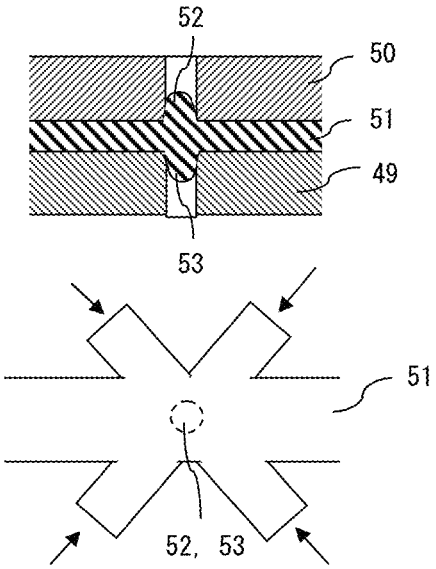
Figure 9D:
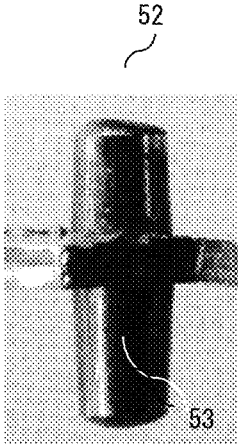

One process extracted from processes of forming two protrusions as an example is shown as a cross-sectional view in the upper part of each drawing of FIGS. 9A and 9C, wherein the processes are performed by clamping a metal plate as an example of the workpiece with a support die and a pressure die, and pressing each cross section of the outer ends of the metal plate by press molding to form the two protrusions on one or both sides of the metal plate. FIG. 9A is a diagram showing a process of simultaneously forming protrusions 42 and 43 at different positions on one surface of a workpiece 41 of the metal plate clamped by a support die 39 and a pressure die 40. FIG. 9B is a diagram showing a process of forming protrusions 47 and 48 at different positions on both sides of a workpiece 46 of the metal plate clamped by a support die 44 and a pressure die 45. In addition, FIG. 9C is a diagram showing a process of forming protrusions 52 and 53 at the same positions on both sides of a workpiece 51 of the metal plate clamped by a support die 49 and a pressure die 50. A photographic view of one protrusion appearance in the protrusions 52 and 53 formed in the process shown in FIG. 9C, is also shown in FIG. 9D. Each figure shown in the lower parts in FIGS. 9A, 9B, and 9C shows each of shapes of the metal plate workpieces 41, 46, and 51 when viewed from the back surface. Each of the shapes has a supporting portion for supporting the protrusions to be formed and portions extending from the supporting portion in two horizontal and vertical directions or four horizontal and diagonal directions. FIGS. 9A, 9B, and 9C show the portions pressed by press molding from four directions indicated by arrows. The circular dotted line shown in the lower part of each drawing of FIGS. 9A to 9C schematically represents the bottom surfaces of the two protrusions to be formed.

In the metal plate workpieces 41, 46, and 51, the portions extending in the two horizontal and vertical directions or the four horizontal and diagonal directions are formed along the pressing direction of the press forming. In the pressing process by the press forming, the metal thinning is observed in the pressing direction, since each cross sections of the end portions of the extended portions moves to the forming position of the protrusions due to the plastic flow of metal.

As shown in FIG. 9A, the protrusions 42 and 43 are formed by the plastic flows of metal portions extending in two horizontal and vertical directions (two vertical directions in the drawing) from the positions of the protrusions 42 and 43, respectively. At this time two protrusions can be formed on one surface of the metal plate workpiece 41 by the same method as the processes shown in FIGS. 1A to 1D, since two through-holes are formed in the pressure die 40.

Regarding the two protrusions 47 and 48 shown in FIG. 9B, one through-hole is formed in the support die 44 and the pressure die 45, respectively. The two protrusions 47 and 48 are formed in two directions (horizontal and vertical directions) from the positions of the protrusions 47 and 48, respectively. In the drawing, one protrusion is respectively formed at a different position on both sides of the metal plate workpiece 46 by the plastic flow of metal parts extending in two horizontal and vertical directions (two upper and lower directions in the drawing) of the metal piece, and thereby a total of two protrusions are formed.

Regarding two protrusions 52 and 53 shown in FIG. 9C, one through-hole is formed in the support die 49 and the pressure die 50, respectively, One protrusion is respectively formed on each of both sides of the metal plate workpiece 51 by each plastic flow of the metal portions extending in four laterally oblique directions (four diagonally up and down directions in the drawing), since the protrusions 52 and 53 are at the same position. As can be confirmed from the photographic diagram shown in FIG. 9D, a total of two protrusions 52 and 53 facing the same position have the height shape having a size larger than the thickness of the metal plate workpiece 51.

Thus, the plurality of solid protrusions are formed at desired positions on one or both sides of the metal plate workpiece. In addition, the plurality of protrusions formed by the present embodiment can be formed simply by filling the metal into the through-holes or the recessed parts corresponding to the through-holes, formed in at least each of the support die and the pressure die, by the plastic flow of metal, wherein the recessed parts serve as female molds for forming the protrusions. Thereby, the plurality of protrusions can be easily formed.

In the present embodiment, the method for forming two protrusions on one or both sides of the metal plate workpiece has been described as an example, but the number of protrusions to be formed may be three or more. Further, when forming the metal portions extending in the horizontal vertical direction or the horizontal diagonal direction from the protrusion position, the most suitable ones can be selected by engineers within the scope of design items, regarding the arrangement angle and the number of arrangements, and the length and width of the extended metal portions. As a result, it is possible to form the plurality of protrusions two-dimensionally not only in one row but also in two or more rows. Furthermore, even when a metal rod is used as the workpiece instead of the metal plate, the plurality of protrusions can be formed anywhere on the metal rod by optimizing the structure of the pressure die and the support die, and the shape and dimension of the recessed parts formed in each die.

Sixth Embodiment

Figure 10A:
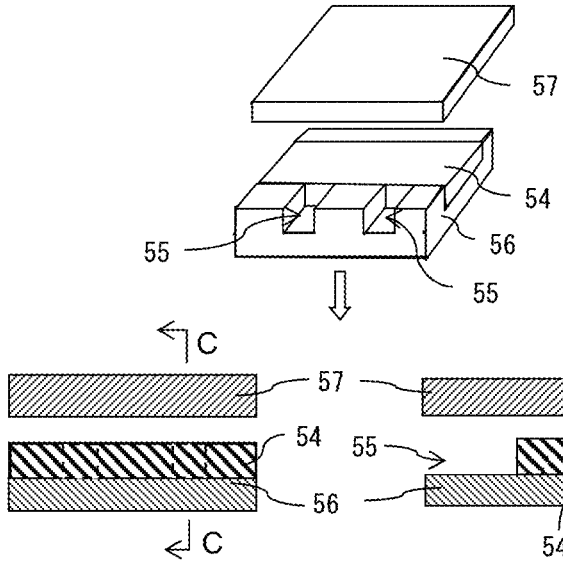
FIGS. 10A to 10D illustrate diagrams showing pressing processes by press forming when a plurality of protrusions are formed on one side of side surfaces of a workpiece of a metal plate in the sixth embodiment of the present invention.
Figure 10B:
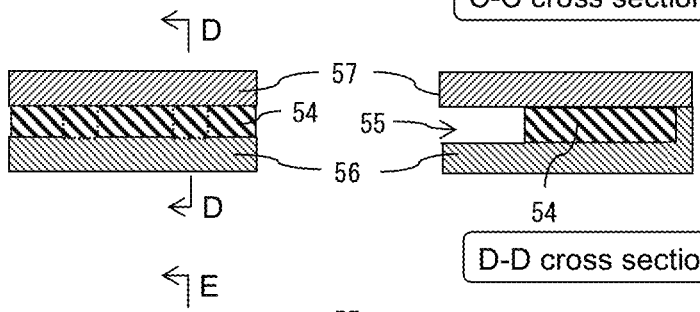
Figure 10C:
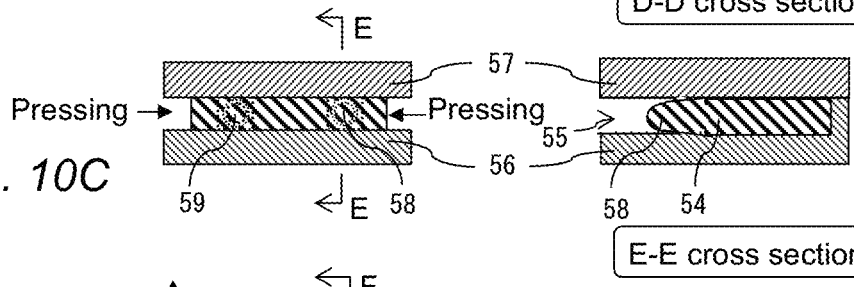
Figure 10D:
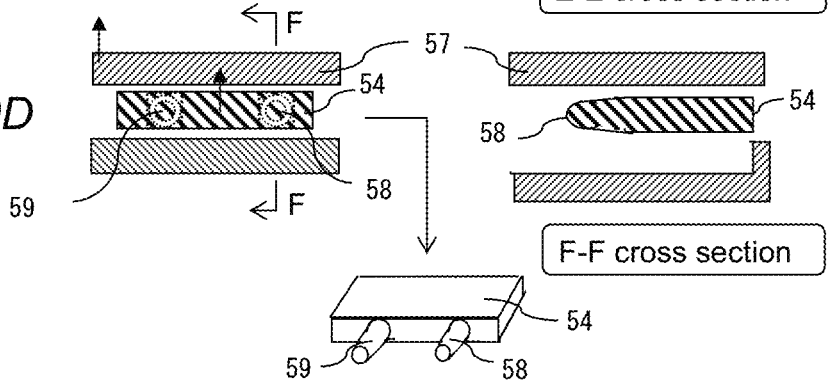

A pressing process by press molding when forming a plurality of protrusions on one side of side surfaces of a metal plate used as a workpiece will be explained by FIGS. 10A to 10D, according to the present embodiment. The figure shown on the left side in each of the processes shown in FIGS. 10A to 10D is a cross-sectional view of the workpiece 54 in the longitudinal direction (left-right direction in the drawing). The figure shown on each right side of FIGS. 10A to 10D corresponds to each cross-sectional view of the positions (C-C), (D-D), (E-E) and (F-F) in the vertically upward and downward directions with respect to the longitudinal direction of the workpiece 54. FIGS. 10A and 10D also show perspective views of the workpiece before and after the formation of the protrusions.

As the workpiece 54, a rectangular copper plate made of C1100-1/4 series copper and having a thickness of 1.5 mm was used. As shown in FIG. 10A, two protrusions were formed by abutting a support die 56 having through-holes 55 at two positions where the protrusions were to be formed on one side surface of the copper plate workpiece 54.

As shown in FIGS. 10A to 10D, in the present embodiment, two protrusions 58 and 59 were formed on one side surface of the workpiece 54 according to the following processes: (a) inserting the workpiece 54 between the support die 56 having a concave step and the through-holes 55, formed at two places in the filled part on one side of the concave step, and a pressure die 57, (b) clamping the workpiece 54 with the support die 56 and the pressure die 57, (c) forming the protrusions 58, 59 (the portions shown by the dotted line in the drawing) by pressing each cross section of the outer shape end parts of the workpiece 54 from two directions (two directions indicated by the arrows in a longitudinal direction of the workpiece 54 by press forming using a press forming machine, and undergoing plastic flows of metal toward the two through-holes 55 corresponding to the recessed parts of the support die 5, and (d) removing the pressure die 57, and taking out the workpiece 54 having the formed protrusions 58 and 59 from the upper part in a state where the clamping die was released. Here, the press molding machine having cam mechanisms at two places to be pressed was used, wherein the press forming machine is a servo press type one that has a cam slide 21 functioning as a pressing die to perform pressing by intermittent feed. The press molding was performed under the same pressing conditions as in the first embodiment. Finally, the workpiece on which the protrusions 58 and 59 were formed was processed into a desired shape by cutting or polishing. If necessary, the workpiece 54 was further subjected to post-processing such as drilling and cutting.

In the processes shown in FIGS. 10A to 10D, two protrusions were formed on one side of the side surfaces of the metal plate workpiece 54, but in the present embodiment, the number and positions of the through-holes 55 formed in the support die 56 may be changed. As a result, one or three or more protrusions can be formed. Further, by adjusting the through-holes 55 formed in the support die 56 so as to match the positions where the protrusions are to be formed on both side surfaces of the workpiece 54, two or more protrusions can also be formed in both sides of the metal plate workpiece 54.

Seventh Embodiment

The method for forming protrusions according to the present invention can not only form one or a plurality of solid protrusions with high strength at arbitrary positions, but also enables to manufacture metal parts having various shapes and functions by combining with a conventional process of press extrusion molding, or press pressing molding on a work surface of a pressure die having recessed parts. Examples of a method for manufacturing a metal component by combination of the method for forming protrusions according to the present invention and another processing method will be explained by FIGS. 11A to 11 D and FIGS. 12A to 12D described later.

FIGS. 11A to 11D illustrate cross-sectional views showing schematic processes of a method for manufacturing a metal component by combining the protrusion forming method of the present invention with the press extrusion molding method. In each of processes shown in FIGS. 11A to 11D, the left side of each drawing illustrates a process of performing the extrusion process by press forming, in which a solid protrusion formed by the protrusion forming method of the present invention is press-formed from the bottom surface of the solid protrusion. The right side of each drawing illustrates a cross-sectional view showing a workpiece of a metal plate observed when the extrusion process is stopped in the middle and the pushing die for extrusion is removed after each of the processes shown in 11B, 11C and 11D.

Figure 11A:
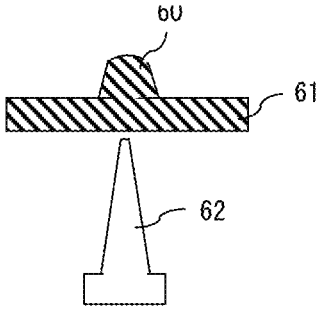
FIGS. 11A to 11D illustrate cross-sectional views showing schematic processes of a method for manufacturing a metal component by combining the protrusion forming method with an extrusion molding method using a press in the seventh embodiment of the present invention.

As shown in FIG. 11A, the extrusion processing by the press forming is performed by extruding a metal plate workpiece 61 having a solid protrusion 60 formed by the present invention from the bottom surface of the workpiece 61 that is located at the center of the bottom surface of the solid protrusion 60, using the pushing die for extrusion 62. Furthermore, the extrusion processing is continued to increase the height of the protrusion 60, as shown in FIGS. 11B to 11D.

Figure 11B:
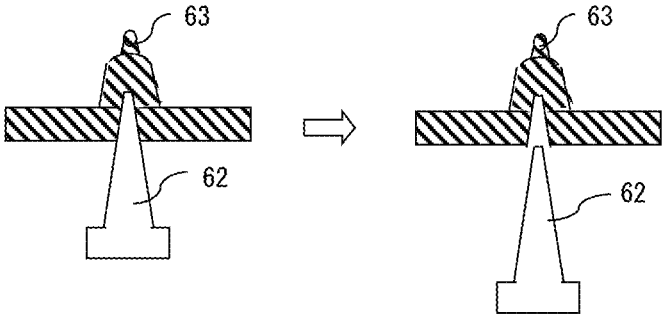
Figure 11C:
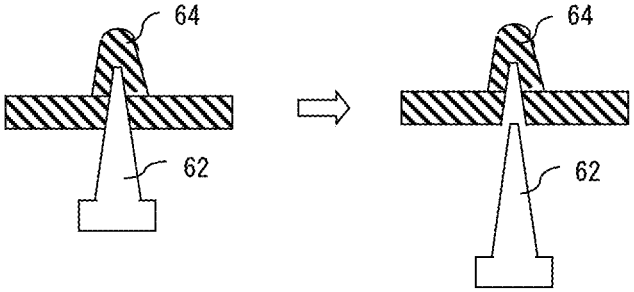
Figure 11D:
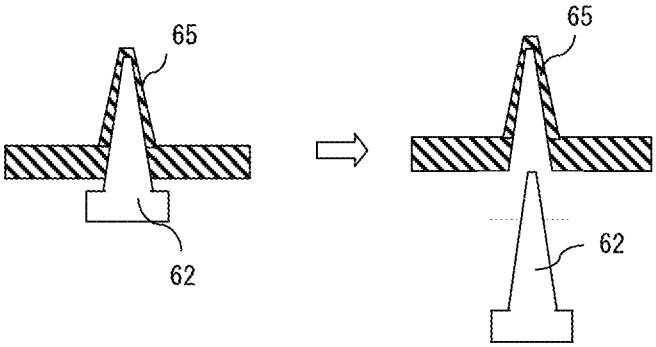

In the present embodiment, a hollow protrusion 63 formed in a stair shape with different bottom diameters can be obtained, when the extruding process by press forming is suspended after the process shown in FIG. 11B and the pushing die 62 is removed. Further, when suspended after the process shown in FIG. 11C, a truncated cone-shaped hollow protrusion 64 can be obtained, wherein a thickness of the tip at the protrusion is thicker than that of the outer peripheral wall. Furthermore, when the extrusion process is continued until the process shown in FIG. 11D, the highest protrusion can be formed as a hollow protrusion 65.

Finally, the workpiece 61 having the hollow protrusion 63, 64 or 65 formed in each process is processed into a metal component having a desired shape and size by removing unnecessary parts from the main body of the workpiece 61 by punching or cutting. If necessary, a post-process of cutting or polishing the formed surface or the back surface of the protrusion may be performed either before or after the process of punching or cutting.

As described above, by combining the protrusion forming method of the present invention with the press extrusion forming method, it is possible to form protrusions having various shapes and structures from the viewpoint of the strength, function and design of the protrusions. At that time, the protrusion forming process and the press extrusion forming process according to the present invention may be performed separately as independent processes, or may be performed as a continuous process by a progressive method or a transfer method.

Eighth Embodiment

FIGS. 12A to 12D illustrate cross-sectional views showing schematic processes when combined with a molding processing method performed by pressing on a work surface, as an example of combining the protrusion forming method of the present invention with another processing method.

Figure 12A:
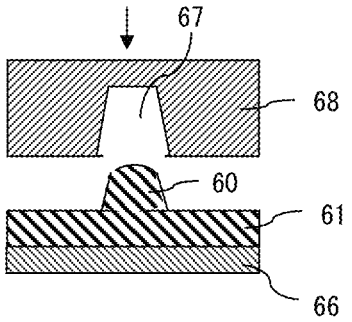
FIGS. 12A to 12D illustrate cross-sectional views showing schematic processes of a method for manufacturing a metal component by combining the protrusion forming method with a molding method of pressing a press die on a workpiece surface in an eighth embodiment of the present invention.
Figure 12B:
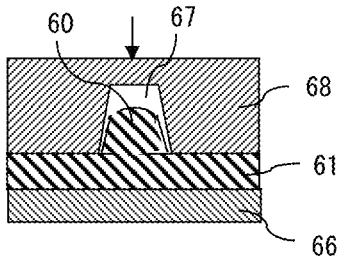
Figure 12C:
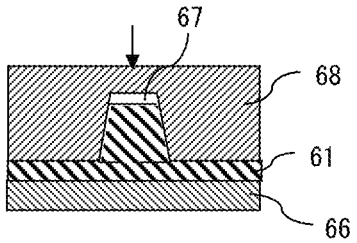
Figure 12D:
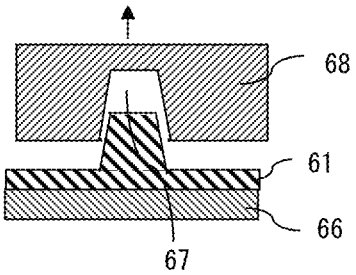

As shown in FIG. 12, a process of the method for manufacturing a metal component according to the present invention comprises: lowering a press die for pressing 68 with a recessed part 67 serving as a female mold for forming a solid protrusion 60, in an arrow direction toward one surface of a workpiece 61, after the metal plate workpiece 61 with the solid protrusion 60 formed by the present invention is supported with a support die 66 (in FIG. 12A); moving the press die for pressing 68 to the workpiece 61 to press onto one surface thereof (FIG. 12B); forming a solid protrusion inside the recessed part 67 while thinning the workpiece 61 by pushing a part of the workpiece 61 into the recessed part 67 through a gap between the solid protrusion 60 and the non-penetrating recessed part 67 by pressing (FIG. 12C); and moving the press die 68 for pressing in the upward arrow direction to remove the pressing press die (FIG. 12D).

The workpiece 61 having the solid protrusion formed by this manner is processed into a metal component having a desired shape and size by removing unnecessary parts from the main body of the workpiece 61 by punching or cutting. If necessary, post-processing of cutting or polishing of the formed surface or the back surface of the protrusion may be performed either before or after the process of punching or cutting.

Although the method for forming a metal component according to the present invention involves the thinning of the workpiece in formation of the projections, the solid protrusions with a higher height or a larger diameter can be formed by combining with the molding process by press pressing on the workpiece surface, as compared with the method of performing the molding process by press pressing alone. At that time, the protrusion forming method and the molding method by press pressing according to the present invention may be separately performed as independent processes, or may be performed as a continuous process by a progressive method or a transfer method.

As described above, the method for forming protrusions according to the present invention can easily form the solid protrusions on the workpiece of the metal plate or the metal rod without making the metal plate thinner, or without deforming the metal rod or reducing the diameter thereof. In addition, the solid protrusion can be formed in the shape with a higher height than the thickness of the metal plate or the diameter of the metal rod, which is used as the workpiece. Since the solid protrusions formed by the method for forming protrusions according to the present invention have high uniformity and strength at the same time, not only high quality protrusions can be obtained, but also two or more protrusions can be formed at a desired position of the workpiece. Further, the protrusions can be formed not only in the direction perpendicular to one surface of the metal workpiece but also in an oblique direction, and the shape of the protrusions can be not only conical but also pyramidal. This results in a wide selection of directions (angles) and the protrusion shapes when forming the protrusions.

In addition, the method for manufacturing a metal component according to the present invention can provide metal components with various shapes and functions by combining with the conventional press extrusion forming method, or the conventional forming method by press pressing, in which the pressure die having the recessed part is pressed onto the workpiece surface. It is therefore possible to provide metal components having various shapes and functions.

INDUSTRIAL APPLICABILITY

The method for manufacturing a metal component according to the present invention can expand its application area not only to general-purpose metal parts but also to precision metal parts.

EXPLANATION OF SYMBOLS

1, 7, 10, 12, 26, 32, 41, 46, 51, 54, 61 . . . Workpiece
2, 27, 33, 39, 44, 49, 56, 66 . . . Support die
3, 28, 34, 40, 45, 50, 57 . . . Pressure die
4, 29, 35, 55 . . . Through-hole
5, 30, 37 . . . Cross end of external peripheral end of the workpiece
6, 31, 38, 42, 43, 47, 48, 52, 53, 58, 59, 60 . . . Protrusion
8 . . . Part supporting the protrusion
9, 11, 13 . . . Portions pressed by press forming
14, 19 . . . System for forming protrusions
15 . . . Clamp plate
16 . . . Press molding machine
17 . . . Pressing die
18 . . . Air vent-hole
20 . . . Cam drive
21 . . . Cam slide
22, 36 . . . Knockout pin
23, 24, 52, 61 . . . Solid protrusion
25 . . . Recessed part
62 . . . Pushing die for extrusion
63, 64, 65 . . . Hollow protrusion
67 . . . Non-penetrating recess
68 . . . Press die for pressing

The invention claimed is:

1. A method for forming one or more protrusions on one or more surfaces of a metal workpiece, the method comprising:

clamping and fixing the metal workpiece between a support die and a pressure die;

wherein at least one of the support die and the pressure die has one or more through-holes to serve as female molds;

pressing end cross sections of two or more outer peripheral end parts of the metal workpiece fixed between the support die and the pressure die at two or more different positions from two or more directions toward the to be formed protrusions on one surface of the metal workpiece by press molding using a pressing die or a pressing jig that is a separate individually movable component from the support die and the pressure die;

forming the one or more protrusions by further pressing the outer peripheral end parts with the pressing die or pressing jig to cause metal plastic flow of the surface of the metal workpiece into said one or more female molds, wherein the pressing is performed at a temperature lower than a softening point of the metal used as the metal workpiece without heating the metal workpiece;

wherein the two or more directions are perpendicular or oblique to an upright direction of the to be formed protrusions on the one surface of the metal workpiece;

wherein said outer peripheral end parts are selected from one of the following:

two or more metal portions extending point symmetrically in different directions from a longitudinal direction of the metal workpiece when a center of a bottom surface of the one or more to be formed protrusions is a symmetrical center; or metal portions extending in a circumferential direction around the bottom surface of the one or more to be formed protrusions.

2. The method for forming protrusions according to claim 1, wherein a pressure for clamping the metal workpiece with the support die and the pressure die is continuously or stepwise increased with pressing time during the press molding.

3. A system for forming one or more protrusions on one surface of a metal workpiece, the system comprising:

a support die configured to support a metal workpiece;

a pressure die configured to suppress a lifting of the metal workpiece;

wherein one or more through-holes are formed in at least one of the support die and the pressure die, the through-holes being configured to serve as female molds for forming the protrusions on one surface of the metal workpiece;

a clamping device configured to clamp the support die and the pressure die;

a pressing die or a pressing jig configured to press end cross sections of two or more outer peripheral end parts of the metal workpiece at two or more different positions from two or more directions toward the to be formed protrusions on one surface of the metal workpiece;

wherein the two more directions are perpendicular or oblique to an upright direction of the protrusions, and the pressing die or the pressing jig being a separate individually movable component from the support die and the pressure die, wherein said two or more different directions are either positioned at the two or more outer peripheral end parts which extend point symmetrically in different directions from a longitudinal direction of the metal workpiece when a center of a bottom surface of the one or more to be formed protrusions is a symmetrical center; or positioned at the outer peripheral end parts that extend in a circumferential direction around the bottom surface of the one or more to be formed protrusions; and a press molding machine equipped with the pressing die or the pressing jig and configured to drive the pressing of the end cross sections at said two or more different positions located in the outer peripheral end parts of the metal workpiece by press molding using the pressing die or the pressing jig, wherein the system has no heating device configured to heat the metal workpiece so that the pressing is performed at a temperature lower than a softening point of the metal used as the metal workpiece without heating the metal workpiece.

4. The system for forming protrusions according to claim 3, wherein the press molding machine for pressing each cross section of the outer peripheral end parts of the workpiece has a cam mechanism for converting a pressing force acting in a direction perpendicular to a clamping surface of the pressure die to a force acting in a direction parallel to the clamping surface through the pressing die or the pressing jig.

5. A method for manufacturing a metal component having protrusions, having a main body part of the metal workpiece and the protrusions protruding from the main body part integrally, the method comprising:

forming the protrusions on the main body part of the metal workpiece by the method for forming protrusions according claim 1; and separating the main body part of the metal workpiece having the protrusions from the metal workpiece by punching or cutting.

6. The method for manufacturing a metal component having protrusions according to claim 5, the method further comprising:

press-extruding rear surfaces of the protrusions or pressing a press die having one or more recessed parts on a work surface of the metal workpiece so as to push a part of the metal workpiece into the recessed parts containing the protrusions while thinning the metal workpiece.

7. The method for manufacturing a metal component having protrusions according to claim 5, the method further comprising:

polishing or cutting back surfaces of the protrusions of the main body part of the metal workpiece.

8. The method for manufacturing a metal component having protrusions according to claim 5, wherein the metal component is a current collecting terminal.

9. A method for manufacturing a metal component having protrusions, having a main body part of the metal workpiece and the protrusions protruding from the main body part integrally, the method comprising:

forming the protrusions on the main body part of the metal workpiece by the method for forming protrusions according to claim 1; and performing another process in combination with the forming of the metal protrusions, the other process including at least one selected from the group consisting of:

separating the main body part of the metal workpiece having the protrusions from the metal workpiece by punching or cutting;

press-extruding rear surfaces of the protrusions, or pressing a press die having one or more recessed parts on a work surface of the metal workpiece so as to push a part of the metal workpiece into the recessed parts containing the protrusions while thinning the metal workpiece; and polishing or cutting back surfaces of the protrusions formed in the main body part of the metal workpiece, wherein the forming of the solid metal protrusions and the other process performed in combination with the forming of the solid metal protrusions are continuously performed by a progressive method or a transfer method.

* * * * *